United States Patent [19]

Hoshino

[11] 4,339,982

[45] Jul. 20, 1982

[54] SNARE BED STRAINER FOR SNARE DRUM

[75] Inventor: Masao Hoshino, Owari Asahi, Japan

[73] Assignee: Hoshino Gakki Ten, Inc., Japan

[21] Appl. No.: 194,982

[22] Filed: Oct. 8, 1980

[30] Foreign Application Priority Data

Nov. 20, 1979 [JP] Japan ..... 54-160592[U]

[51] Int. Cl.[3] ..... G10D 13/02

[52] U.S. Cl. ..... 84/415

[58] Field of Search ..... 84/415–417

[56] References Cited

U.S. PATENT DOCUMENTS 2,096,209 10/1937 Strupe ..... 84/415

4,138,920 2/1979 Meador ..... 84/415

FOREIGN PATENT DOCUMENTS 841771 7/1960 United Kingdom ..... 84/415

1106854 3/1968 United Kingdom ..... 84/417

*Primary Examiner*—Lawrence R. Franklin

[57] ABSTRACT

The disclosure concerns apparatus for maintaining continuous tension on the snare bed of a snare drum and for moving the snare bed toward and away from the drum head surface while the snare bed remains tensioned and while the orientation of the snare bed strands remains generally parallel to the drum head surface. The snare bed is held under tension by band presses at opposite sides of the drum shell. Pivoting links at both sides of the drum shell are normally spring biased against the tension of the band presses to move the snare bed away from the drum head surface. Upon a release in the tension of the tensioning means, the spring biased levers, pivot to move the snare bed away from the drum head. Upon an increase in tension of the tensioning means, the biasing force on the links is overcome and the snare bed moves back to the drum head surface.

5 Claims, 3 Drawing Figures

SNARE BED STRAINER FOR SNARE DRUM

BACKGROUND OF THE INVENTION

The present invention relates to a snare drum, more particularly to the snare bed and even more particularly to a snare bed strainer for moving the snare bed into contact with and out of contact with the drum head of a snare drum.

The snare bed of a snare drum comprises a number of sound wires, which may be in the form of coiled springs, that contact the bottom drum head of a snare drum and are vibrated by the vibration of the drum head for generating additional noise. The snare bed must be installed at and is occasionally removed away from contact with the drum head.

The snare bed comprises a plurality of side-by-side sound wires which extend between metal pieces. A respective support band is attached to each of the metal pieces. The support bands are fastened to the shell of the drum, typically at opposite sides of the drum. The support bands must be pulled apart so that the wires of the snare bed will be held under tension against the drum head surface. To this end, there is typically provided a stationary band press at one side of the drum shell and a movable or tensionable band press on the other side of the drum shell. One snare bed band is held in the stationary press. The other snare bed band is pulled up in the movable press which draws the sound wires tight against the drum head. One typical movable band press is made to be slidable up and down along the drum shell by means of a link mechanism. Typically, the bands at the end of the snare bed pass through guide holes in the rim of the drum shell and the guide holes position the snare bed.

When the movable band press is operated to tension the snare bed, the metal pieces at the ends of the wires of the snare bed slide along the drum head surface, and possibly may damage that surface. Furthermore, to loosen the snare bed and separate it from the drum head, the movable band press is operated to relieve the pulling on the bands and the snare bed becomes slack and separates from the drum head. The snare bed remains in a loosened, untensioned state after it has been separated from the drum head. In this position, the wires of the snare bed may be vibrated by the noise generated by playing of the drum or by vibrations from another musical instrument, whereby the snare bed wires may continue to produce noise. Furthermore, noise is occasionally generated during tensioning of the snare bed by movement of the movable band press. This noise can produce undesirable effects during the playing of music and particularly when fine quality recordings are made.

SUMMARY OF THE INVENTION

Accordingly, it is the primary object of the present invention to effectively separate the snare bed from a drum head and bring the snare bed into contact with the drum head.

It is another object of the invention to cause such separation and bringing together of the snare bed and the drum head without damaging the drum head.

It is a further object of the invention to cause such separation and bringing together without generating noise.

It is yet another object of the invention to aid in preventing the snare bed from generating noise when it is separated from the drum head and while it remains separated from the drum head and is still supported on the drum.

It is another object of the invention to maintain the snare bed in a tensioned condition while it is in contact with the drum head and also while it is separated from the drum head.

It is a further object of the invention to separate the snare bed from contact with the drum head and to move the snare bed into contact with the drum head with the wires of the snare bed at an orientation where they are generally parallel to the drum head.

In the present invention, the snare bed is supported to the shell of the drum by respective band presses at both bands of the snare bed. At least one of the band presses is a movable band press for tensioning the snare bed, as in the prior art.

According to the present invention, at opposite sides of the drum shell, between the band press and the drum head, a respective biasing means is provided for normally biasing the respective side of the snare bed to move away from the drum head. The band presses together act as tensioning means which continuously tensions the snare bed in opposition to both of the biasing means. Preferably, both biasing means exert the same force so that they shift together, as described below.

When the tension on the tensioning means is reduced, the biasing means are able to simultaneously lift both ends of the snare bed off the drum head surface without scraping the snare bed wires or the metal pieces at the ends of the wires across the drum head surface. Protection against scraping is achieved because the snare bed remains tensioned and the biasing means keeps the snare bed under tension, whereby the snare bed does not become slack and, therefore, does not slide across the drum head. Furthermore, the cooperating biasing means tend to move both ends of the snare bed away from the drum head at the same time, whereby the snare bed wires remain parallel to the drum head as the snare bed moves away from and comes into engagement with the drum head. The presence of biasing means at both ends of the snare bed holds the snare bed under tension even after it has moved away from the drum head, thereby preventing the snare bed from being slack and preventing the undesired generation of noise which the wires of a slack snare bed might cause.

Each biasing means comprises a pivotable link at a respective side of the drum shell and the link pivots about a respective journal on the drum shell. A roller is provided on each link and one of the snare bed bands is wrapped around each roller, so that the snare bed need not slide with respect to the biasing means, but can simply roll over a rotating roller as the biasing means pivoting lever pivots.

Other objects and features of the invention will become apparent from the following description and the accompanying drawings.

DESCRIPTION OF THE PREFERRED EMBODIMENT

Figure 1:
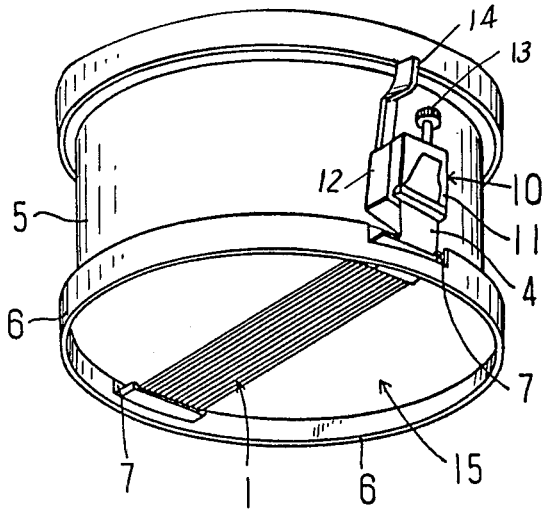
FIG. 1 is an oblique, bottom, perspective view of a snare drum.
Figure 2:
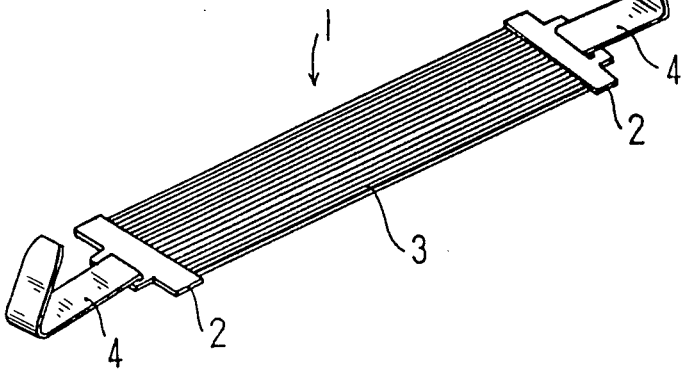
FIG. 2 is a perspective view of a snare bed for use in a snare drum.

The invention is concerned with a roller type, parallel action snare bed strainer for selectively tightening the strands of the snare bed 1 to the drum head surface 15 and for separating the strands of the snare bed from the drum head surface. As shown in FIGS. 1 and 2, the snare bed 1 comprises a number of sound generating strands, in the form of metal wires, cables or springs which extend between two spaced apart metal support pieces 2. On the completed drum, the metal support pieces are located near the shell of the drum. The metal pieces 2 are in turn supported on metal bands or belt sections 4. As shown in FIG. 1 the snare bed is supported at the lower drum head surface and it is either moved into contact with that drum head surface or is separated from that surface, as required.

As shown in FIG. 1, there is an annular rim 6 at the lower end of the drum shell. Snare bed guide holes 7 are provided in the rim 6 and they extend along the height of the rim to extend past and beneath the lower drum head surface. The bands 4 are intended to pass through the guide holes 7 and the guide holes 7 are positioned at opposite sides of the rim 6 for orienting and positioning the snare bed.

Figure 3:
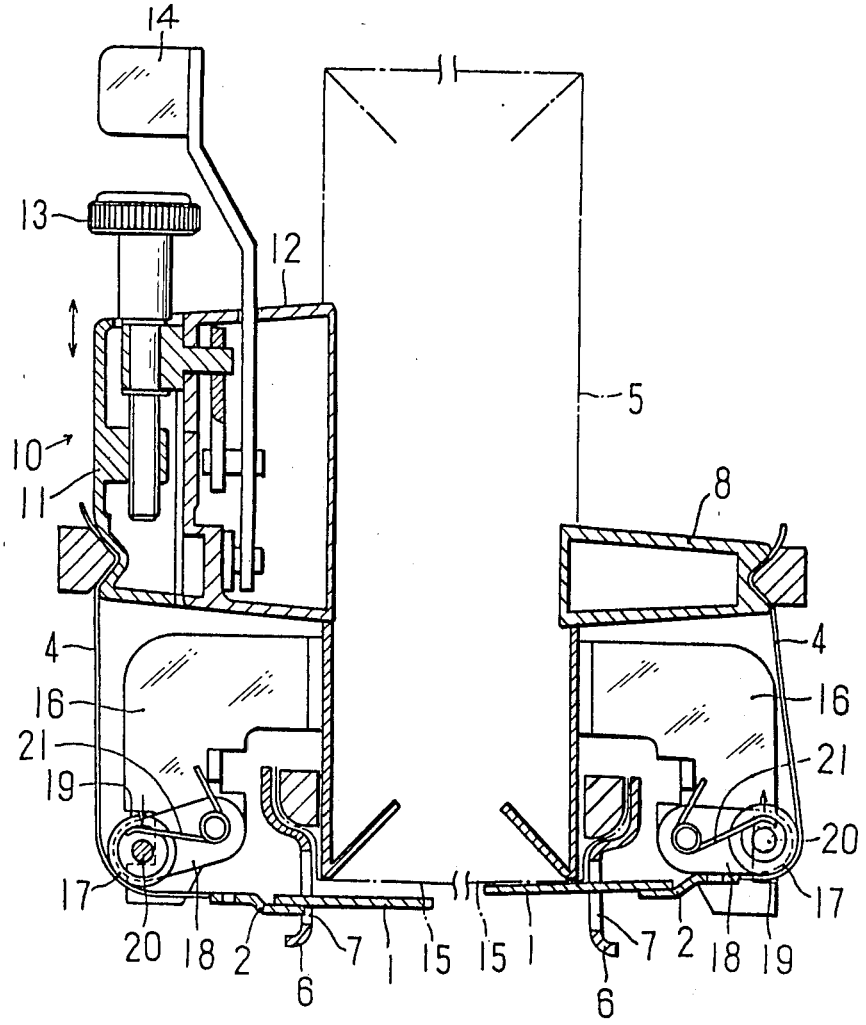
FIG. 3 is a cross-section of a drum which has been equipped with the apparatus according to the invention.

At one side of a conventional drum shell, a fixed band press 8 for the band 4 (as shown in FIG. 3) fixedly holds the respective band 4 in place. A movable band press 10 is provided on the opposite side at the surface of the shell of the drum and it is movable to pull its band 4 and tension the strands of the snare bed. The known movable band press 10 shown in FIG. 1 comprises a band press part 11 which is freely slid vertically up and down by means of a link mechanism (shown in FIG. 3) located on a seat 12. The adjusting bolt 13 adjusts the tension of the snare bed held in the band pressing part 11. In the aforementioned conventional snare bed, the bands 4 at both ends of the snare bed are inserted through the guide holes 7. One band 4 is installed at the stationary band press 8 to hold the snare bed at the lower drum head surface. The band 4 at the other end of the snare bed is installed in the movable band press 10.

A snare bed installed in this manner has its strands tightened and loosened by the band press portion of the movable band press 10 sliding up and down on the seat 12 through operation of the lever 14 of the link mechanism. This causes the strands of the snare bed either to contact or to become separated from the lower drum head surface 15. However, as the snare bed becomes separated from the drum head surface 15, the metal pieces 2 at the end of the snare bed wires may slide along the drum head surface 15 and could damage that surface. Furthermore, since the strands of the snare bed remain in the loosened state after they have been separated from the drum head surface, the strands of the snare bed may be vibrated by the noise generated during the playing of the drum itself or by the vibration of the drum or by the noise of other musical instruments, whereby the snare bed tends to produce its own noise. Furthermore, noise may even be produced as the snare bed is pulled up from one side by the movable band strainer 10. The aforesaid small noises become magnified and very noticeable, during recording in particular.

The present invention has as its object moving of the strands of the snare bed either into contact with the drum head surface or away from contact with the drum head surface with the strands of the snare bed remaining under continuous tension and at an orientation parallel to the lower drum head surface during and after such movement. Furthermore, during establishment of contact between the strands of the snare bed and the drum head surface and during their separation from the drum head surface, the metal pieces at both ends of the snare bed are prevented from sliding on the drum head surface, which prevents damage to the drum head surface. Since the snare bed moves while remaining oriented parallel to the drum head surface, the snare bed is not loosened from its normal state of tension, as occurs with the conventional movable band strainer, and the snare bed may remain continuously under tension even as its strands are moved out of contact with and into contact with the lower drum head surface. Therefore, the invention provides a strainer for the snare bed of a snare drum in which no noise is produced at the time of playing of the drum or at the time of movement of the snare bed.

Referring to FIG. 3, the lower rim 6 of the shell of the drum includes the snare bed guide holes 7 at opposite positions around the rim of the shell 5. At one side of the shell, there is a fixed band press 8 which holds one band 4. The movable band press 10 of the strainer is provided at the other side of the shell 5 of the drum.

Outside of each snare bed guide hole 7, there is a respective biasing means for biasing the respective end of the snare bed at the band 4 away from the drum head surface and counter to the bias of the snare bed tensioning movable band press. Each biasing means includes a respective guide roller 17. Each guide roller 17 is journaled to the tip of a respective link 18 and the link is, in turn, journaled on the base side of a support plate 16 that is carried on the outside of the shell 5 of the drum. Thus, the roller 17 may rotate about its axis 20 on the link 18 and the roller 17 may pivot about the journaled pivot mount for the link 18.

Both ends of the axis 20 of the roller 17 are held in a guide groove 19 which is defined in the outwardly facing side of the support plate 16. The guide groove 19 defines the vertical limits of pivoting of the guide roller 17 and permits the guide roller 17 to move up and down.

A respective torsion spring 21 is carried on the pivot axis for each link 18. It abuts against an abutment projecting from the support plate 16, on the one hand, and abuts against the support axis for the roller. This normally urges the roller 17 down, which would tend to drive the snare bed 1 away from the lower drum head surface 15. Both springs 21 have the same strength.

In the snare bed 1, one end band 4 is held in the fixed band press as noted. The other end band 4 is held in the movable band press 10. The lever 14 is moved to loosen the tension on the snare bed. Once the tension on the snare bed is slightly reduced, both guide rollers 17 therefor are urged downwardly by the respective springs 21 and they simultaneously move downward. The snare bed 1 moves away from the lower drum head surface 15 while remaining parallel to that drum head surface. In the meantime, the spring tension on the rollers holds the snare bed 1 under tension. As a result, the snare bed is separated from the lower drum head surface in a tensioned state and not in a loosened state. The snare bed is shown in its state in contact with a lower drum head surface at the right-hand half of FIG. 3 and is shown separated from the drum head surface at the left-hand half of FIG. 3.

When the snare bed is pulled tight by contrary operation of the lever 14, the tensile force exerted on the snare bed becomes greater than the forces of the springs 21 biasing the rollers 17 downward. As a result, the guide rollers 17 are both pivoted upward around the respective pivot axes of the links 18. The snare bed again moves toward contact with the lower drum head surface while remaining parallel thereto and eventually contacts the drum head surface at a flat orientation and parallel thereto, as shown at the right in FIG. 3.

Because the metal pieces 2 at both ends of the snare bed do not slide over the drum head surface, they do not damage the drum head surface. Were the snare bed to be made longer, furthermore, it is possible to apply the sound wire portion 3 of the snare bed to the drum head surface, thereby manifesting the snare effect to the fullest extent.

With the invention, the snare bed need never assume a loosened state at the time that it is separated from the drum head surface, so that there is no possibility of noise being produced by the loosened snare bed while music is being played.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A snare bed strainer, adapted for moving the snare bed of a snare drum selectively into and out of contact with a cooperating drum head, wherein the drum includes a shell, a drum head which is adapted to vibrate and which is located toward an end of the shell, and a rim of the shell at that end of the shell, and wherein the snare bed comprises a plurality of strands for extending across the drum head and for contacting the surface of the drum head and comprises bands at the ends of the strands for supporting the strands to the drum shell, the snare bed strainer comprising:

first press means at a side of the drum shell for supporting one of the bands to the drum shell; second press means at a side of the drum shell, across the drum body from the first press means, for supporting the other band of the drum shell; at least one of the press means including tensioning means for tensioning the snare bed strands by pulling the bands between the press means;

at at least one of the sides of the drum body and near the respective press means a pivotable link being journaled to the drum shell normally extending outwardly from the journal thereof away from the other press means to a snare engaging part and being pivotable around the journal thereof along a pathway for moving the snare bed selectively away from the drum head surface and to the drum head surface, and the snare bed passing over the link engaging part to be moved such that the snare bed may move away from the drum head and to the drum head as the link pivots; a spring for acting on the link for normally biasing it to pivot to move the snare bed away from the drum head in opposition to the force of the tensioning means on the snare bed, and the snare bed springs also being movable in opposition to their own biasing force to move the snare bed to the drum head;

such that upon a decrease in tension of the snare bed by the tensioning means, the springs lift the snare bed away from the drum head surface, and upon an increase in tension of the snare bed by the tensioning means beyond a predetermined tension, the tensioning means exert a tensioning force in opposition to and greater than the force which the springs exerts on the snare bed, whereby the springs shifts to permit the snare bed to move into contact with the drum head surface.

2. A snare bed strainer adapted for moving the snare bed of a snare drum selectively into and out of contact with a cooperating drum head, wherein the drum includes a shell, a drum head which is adapted to vibrate and which is located toward an end of the shell, and a rim of the shell at the end of the shell, and wherein the snare bed comprises a plurality of strands for extending across the drum head and for contacting the surface of the drum head and comprises bands at the ends of the strands for supporting the strands to the drum shell, the snare bed strainer comprising:

first press means at a side of the drum shell for supporting one of the bands to the drum shell; second press means at a side of the drum shell, across from the first press means, for supporting the other band to the drum shell; at least one of the press means including tensioning means for tensioning the snare bed strands by pulling the bands between the press means;

at the sides of the drum shell and near each respective press means, a pivotable link being journaled to the drum shell, normally extending outwardly from the journal thereof away from the other press means to a snare engaging part of the link, and the link being rotatable around the journal thereof along a pathway for moving the snare bed selectively away from the drum head surface and to the drum head surface, and the snare bed passing over the snare engaging parts to be moved such that the snare bed may move away from the drum head and to the drum head as the links pivot; a spring for acting on each link for normally biasing it to pivot to move the snare bed away from the drum head in opposition to the force of the tensioning means on the snare bed, and the springs also being movable in opposition to their own biasing force to move the snare bed to the drum head;

such that upon a decrease in tension of the snare bed by the tensioning means, both of the springs together lift the snare bed away from the drum surface, and upon an increase in tension of the snare bed by the tensioning means beyond a predetermined tension, the tensioning means exert a tensioning force in opposition to and greater than the force which both springs exert on the snare bed, whereby the springs shift to permit the snare bed to move into contact with the drum head surface.

3. The apparatus of claim 2, wherein both springs are to such respective strengths that they move together to move the snare bed to and away from the drum head surface.

4. The apparatus of either of claims 2 or 3, wherein the snare bed engaging part of each link includes a rotatable roller thereon away from the journal mounting of the link, and the snare bed passing over the roller, whereby as the link pivots, the snare bed will roll over the roller.

5. The apparatus of claim 2, wherein the rim of the drum shell has openings therethrough, at the sides of the drum, through which the snare bed passes to the press means for thereby positioning the snare bed around the drum head.

* * * * *